US006558295B2

(12) United States Patent
Araki et al.

(10) Patent No.: US 6,558,295 B2
(45) Date of Patent: May 6, 2003

(54) JUNGLE GYM

(75) Inventors: Katsumi Araki, Tokyo (JP); Shigeru Kanauchi, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 09/854,690

(22) Filed: May 15, 2001

(65) Prior Publication Data

US 2002/0010054 A1 Jan. 24, 2002

(30) Foreign Application Priority Data

Jun. 5, 2000 (JP) ..... 2000-167753

(51) Int. Cl.[7] ..... A63B 9/00; A63B 17/00

(52) U.S. Cl. ..... 482/35; 482/36; 482/37; 482/38; 482/39

(58) Field of Search ..... 482/35–38; 476/116; D21/242; 472/116, 117

(56) References Cited

U.S. PATENT DOCUMENTS

| | | | | |
|---|---|---|---|---|
| 3,752,472 A | * | 8/1973 | Snead | 482/35 |
| 4,227,688 A | * | 10/1980 | Senoh et al. | 482/38 |
| 4,815,727 A | | 3/1989 | Kiribuchi | 272/1 R |
| 5,356,354 A | * | 10/1994 | Owens | 482/35 |
| 5,755,641 A | | 5/1998 | Pardella | 482/36 |
| 6,001,020 A | * | 12/1999 | Nagelski et al. | 472/116 |

FOREIGN PATENT DOCUMENTS

| | | |
|---|---|---|
| FR | 2267133 | 4/1975 |
| FR | 2267133 | * 7/1975 |
| JP | 7-24396 | 5/1995 |
| JP | 7-289113 | 11/1995 |
| JP | 3058380 | 3/1999 |
| JP | 3065914 | 11/1999 |

* cited by examiner

*Primary Examiner*—Nicholas D. Lucchesi
*Assistant Examiner*—Lori Baker Amerson
(74) *Attorney, Agent, or Firm*—Staas & Halsey LLP

(57) ABSTRACT

A jungle gym requiring a small storage space and easy assembly is provided. A jungle gym comprises a main frame body comprising connecting bars extending vertically or horizontally. The main frame body has a shape of an approximate cube or an approximate rectangular parallelepiped as a whole by connecting the connecting bars. The jungle gym also has a sub-frame body being attached to the main frame body and turnable around one of connecting bars of the main frame body or around an axis being parallel to the one of connecting bars. The sub-frame body is capable of folding along the main frame body.

15 Claims, 9 Drawing Sheets

JUNGLE GYM

BACKGROUND OF THE INVENTION

1. Field of the Invention

This invention relates to a jungle gym for a small child playing indoors.

2. Description of the Related Art

A jungle gym is constituted by edges of connecting bars, combined mutually as two or more cube type frame bodies pieced together.

Since the jungle gym is large-sized, while not using it, it will become obstructive. Then, as for the jungle gym used indoors, it is common to render the jungle gym to be demountable in order to make storage space small. However, when using the jungle gym again, it has to be assembled and the work is complicated.

SUMMARY OF THE INVENTION

Then, an object of the present invention is to provide a jungle gym requiring a small storage space and easy assembly.

In order to accomplish the above-described object, in one aspect of the present invention, a jungle gym comprises a main frame body comprising connecting bars extending vertically or horizontally. The main frame body has a shape of at least one of an approximate cube and an approximate rectangular parallelepiped as a whole by connecting the connecting bars. The jungle gym also comprises a sub-frame body that is attached to the main frame body and turnable around one of connecting bars of the main frame body or around an axis being parallel to the one of connecting bars. The sub-frame body is capable of folding along the main frame body. Although the sub-frame body in this case is not particularly limited, it is preferable that the sub-frame body may have an L-like portion when seeing from a direction of a turning axis of the sub-frame body, and the L-like portion may be folded along two sides of the main frame body to overlap with the two sides. The connecting bar may be joined or connected mutually to form the approximate cube or the approximate rectangular parallelepiped of the main frame body. The sub-frame body may have a plurality of approximate squares or approximate rectangles, which are formed by joining or connecting the connecting bars extending vertically or horizontally.

According to the jungle gym, the sub-frame body may be folded along the main frame body when the jungle gym is put away on a storage space or when it is not used, while the sub-frame body may be deployed or unfolded from the main frame body at the time of use.

The jungle gym may further comprise a connecting turn bar that is attached to at least one of the main frame body and the sub-frame body, and capable of turning along a vertical plane or a horizontal plane and of folding to overlap with an adjacent connecting bar. The connecting turn bar may be bridged between the main frame body and the sub-frame body and connected detachably to a rest of the main frame body and the sub-frame body by a joint. The connecting turn bar may be attached to a corner of the main frame body or the sub-frame body.

FIGS. 1A to 1F are conceptual views of the jungle gym, showing a frame body 100 shown with diagonal lines as the main frame body. A sub-frame body 200 is provided next to the main frame body 100. The main frame body 100 and the sub-frame body 200 are connected by a connecting turn bar 300.

According to the jungle gym, the sub-frame body may be folded along the main frame body when the jungle gym is put away on a storage space. At the time of use, the sub-frame body may be unfolded from the main frame body, and then the connecting turn bar may connect the sub-frame body and the main frame body.

The jungle gym may comprise two or more sub-frame bodies.

FIGS. 2A to 2H are conceptual views of the jungle gym, wherein a frame body 100 shown with diagonal lines represents the main frame body, and a sub-frame body 200 is provided next to the main frame body 100. Connecting turn bars 300 connect the main frame body 100 and the sub-frame body 200.

According to the jungle gym, the sub-frame body may be folded along the main frame body when the jungle gym is put away on a storage space. At the time of use, the sub-frame body may be unfolded from the main frame body, and then the connecting turn bars may connect the sub-frame body and the main frame body.

According to another aspect of the present invention, a jungle gym comprises a main frame body comprising connecting bars extending vertically or horizontally. The main frame body has a shape of at least one of an approximate cube and an approximate rectangular parallelepiped as a whole by uniting the connecting bars. The jungle gym also comprises a plurality of sub-frame bodies that is attached to the main frame body and capable of turning along a vertical plane or a horizontal plane. The sub-frame body is capable of folding along the main frame body. The jungle gym further comprises a connecting turn bar that is attached to at least one of the main frame body and the sub-frame body, and that is capable of turning along a vertical plane or a horizontal plane and of folding to overlap with an adjacent connecting bar. The connecting turn bar is bridged at least one of between the main frame body and the sub-frame body and between the sub-frame bodies, and the connecting turn bar is connected detachably thereto by a joint.

FIGS. 3A and 3B are conceptual views of the jungle gym, showing a frame body 100 as the main frame body shown with diagonal lines. A sub-frame body 200 is provided next to the main frame body 100. Connecting turn bars 300 connect the sub-frame bodies 200.

According to the jungle gym, the sub-frame body may be folded along the main frame body when the jungle gym is put away on a storage space. At the time of use, the sub-frame body may be unfolded from the main frame body, and then the connecting turn bars may connect the sub-frame bodies.

The jungle gym may further comprise two turn frames, each being attached independently to two parallel connecting bars among the connecting bars of the main frame body. The two turn frames may be capable of turning along a plane, which is perpendicular to the two connecting bars, and of moving into a storage position in the main frame body. The jungle gym may further comprise a connecting turn bar that is attached to at least one turn frame and is capable of folding to overlap with an adjacent connecting bar. The connecting turn bar may be bridged between the two turn frames when the connecting turn bar is unfolded. The connecting turn bar may be detachably connected to the other turn frame by a joint. The turn frame may have connecting bars and a U-like or an L-like shape, which may be formed by joining or connecting the connecting bars.

FIGS. 4A and 4B are conceptual views of the jungle gym. A frame body 100 shown with diagonal lines represents the main frame body. The main frame body 100 is provided with turn frames 400. Connecting turn bars 300 connect the turn frames 400.

According to the jungle gym, the turn frames may be folded to the main frame body when the jungle gym is put away on a storage space. At the time of use, the turn frames may be unfolded from the main frame body, and then the connecting turn bars may connect the turn frames.

The jungle gym may also comprise two turn frames, each being attached independently to two parallel connecting bars among the connecting bars of the main frame body and the sub-frame body. The turn frames may be capable of turning along a plane, which is perpendicular to the two connecting bars, and of moving into a storage position in a frame body including the connecting bars. The jungle gym may further comprise a connecting turn bar that is attached to at least one turn frame, and that is capable of folding to overlap with an adjacent connecting bar. The connecting turn bar may be bridged between the two turn frames when the connecting turn bar is unfolded, and then to be detachably connected to the other turn frame by a joint.

FIGS. 5A and 5B are conceptual views of the jungle gym. A frame body 100 shown with diagonal lines represents the main frame body, and a frame body 200 represents the sub-frame body. Both the main frame body 100 and the sub-frame body 200 are provided with turn frames 400. Connecting turn bars 300 connect the turn frames 400.

According to the jungle gym, the turn frame may be folded along the main frame body when the jungle gym is put away on a storage space. At the time of use, the turn frame may be unfolded from the main frame body, and then the connecting turn bars may connect the turn frames.

With the jungle gym, the sub-frame body may be capable of being unfolded beside the main frame body. The jungle gym may further comprise a board that is attached to an upper connecting bar of the sub-frame body and turnable along a vertical plane. The board may be capable of folding to overlap with the sub-frame body and of being held horizontally by a support by other connecting bar.

According to the jungle gym, the board may be folded to overlap with the sub-frame body when the jungle gym is put away on a storage space, while at the time of use, the board may be unfolded from the sub-frame body.

The jungle gym may further comprise a slide that is attached to an upper connecting bar of the sub-frame body and turnable along a vertical plane. The slide may be capable of folding along the sub-frame body and telescopic. A folding leg may be provided to a back side of the slide.

According to the jungle gym, the slide may be folded to the sub-frame body when the jungle gym is put away on a storage space, while at the time of use, the slide may be unfolded from the sub-frame body.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE EMBODIMENTS

Hereinafter, a jungle gym according to embodiments of the present invention will be explained based on the drawings.

Figure 6E:
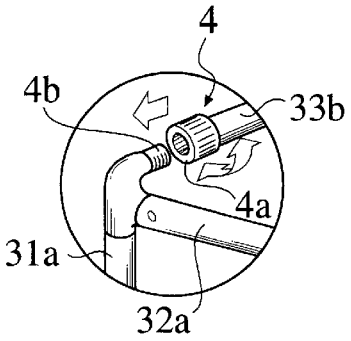
FIG. 6E is an enlarged view of a joint of the jungle gym of FIG. 6A.
Figure 6B:
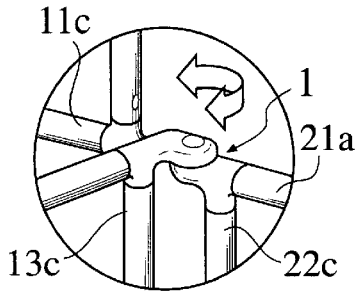
FIG. 6B is an enlarged view of a hinge of the jungle gym of FIG. 6A.
Figure 6A:
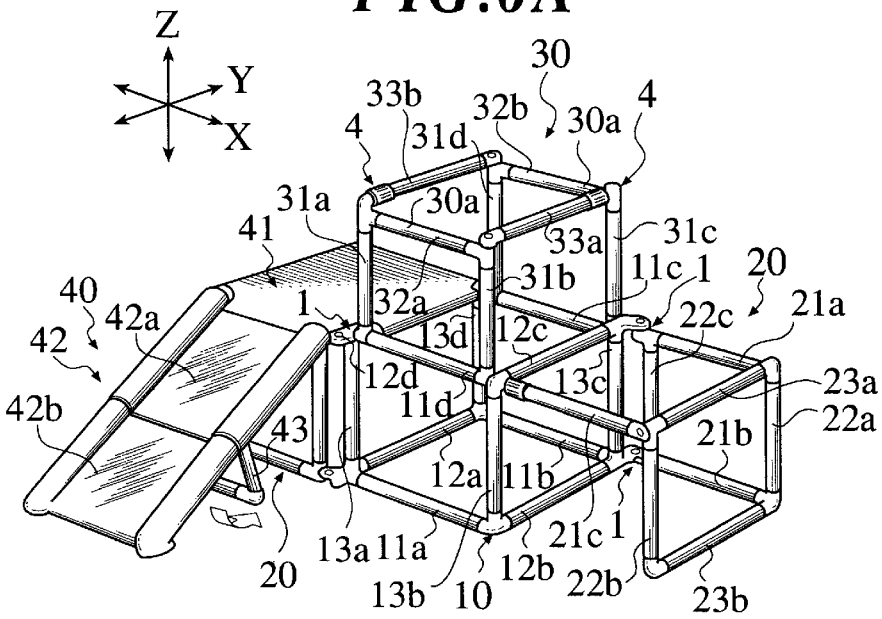
FIG. 6A is a perspective view of a jungle gym according to an embodiment of the present invention, showing that the jungle gym is unfolded.
Figure 7:
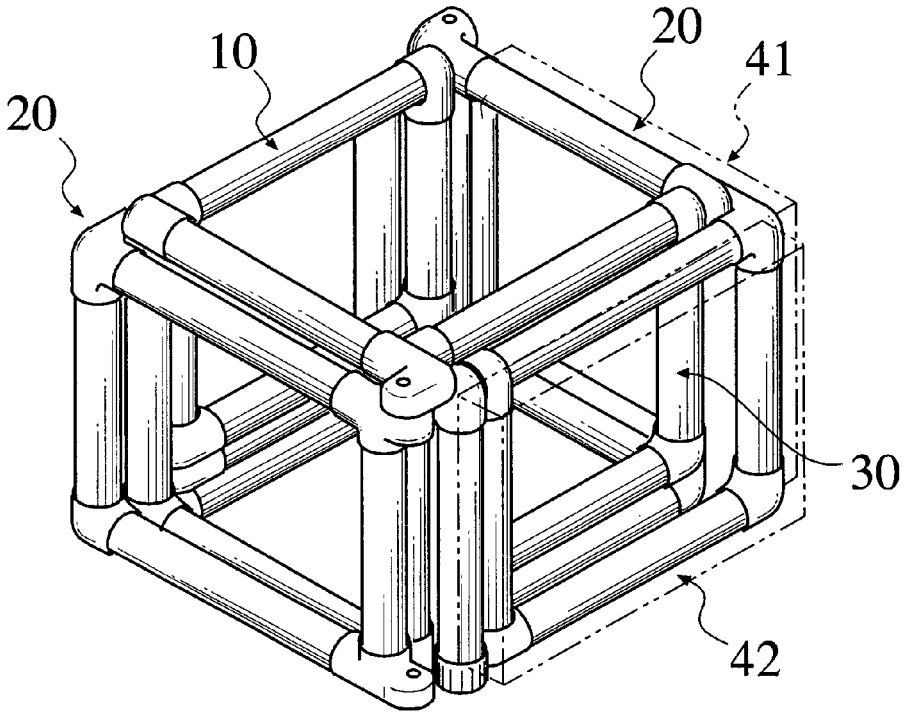
FIG. 7 is a perspective view of the jungle gym of FIG. 6A, showing that it is folded.
Figure 8:
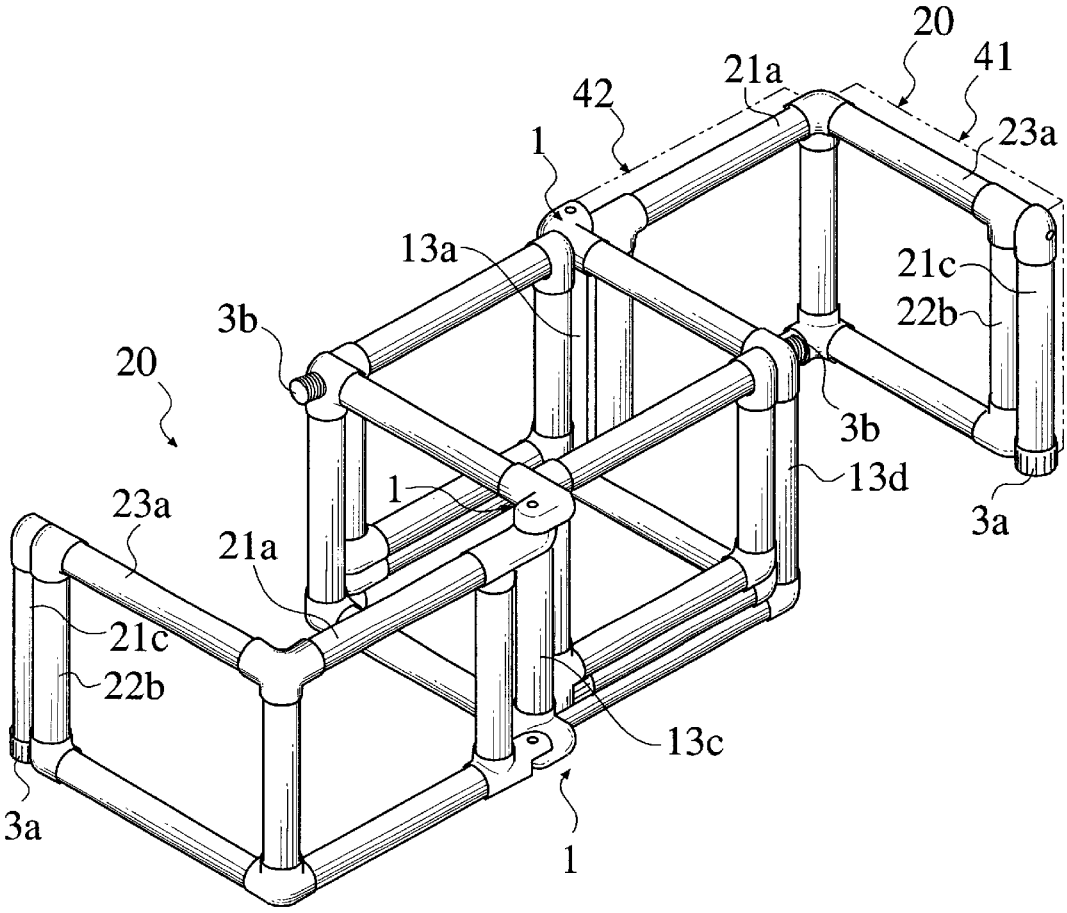
FIG. 8 is a perspective view showing an example of an assembling process for the jungle gym according to the embodiment of the present invention.
Figure 9:
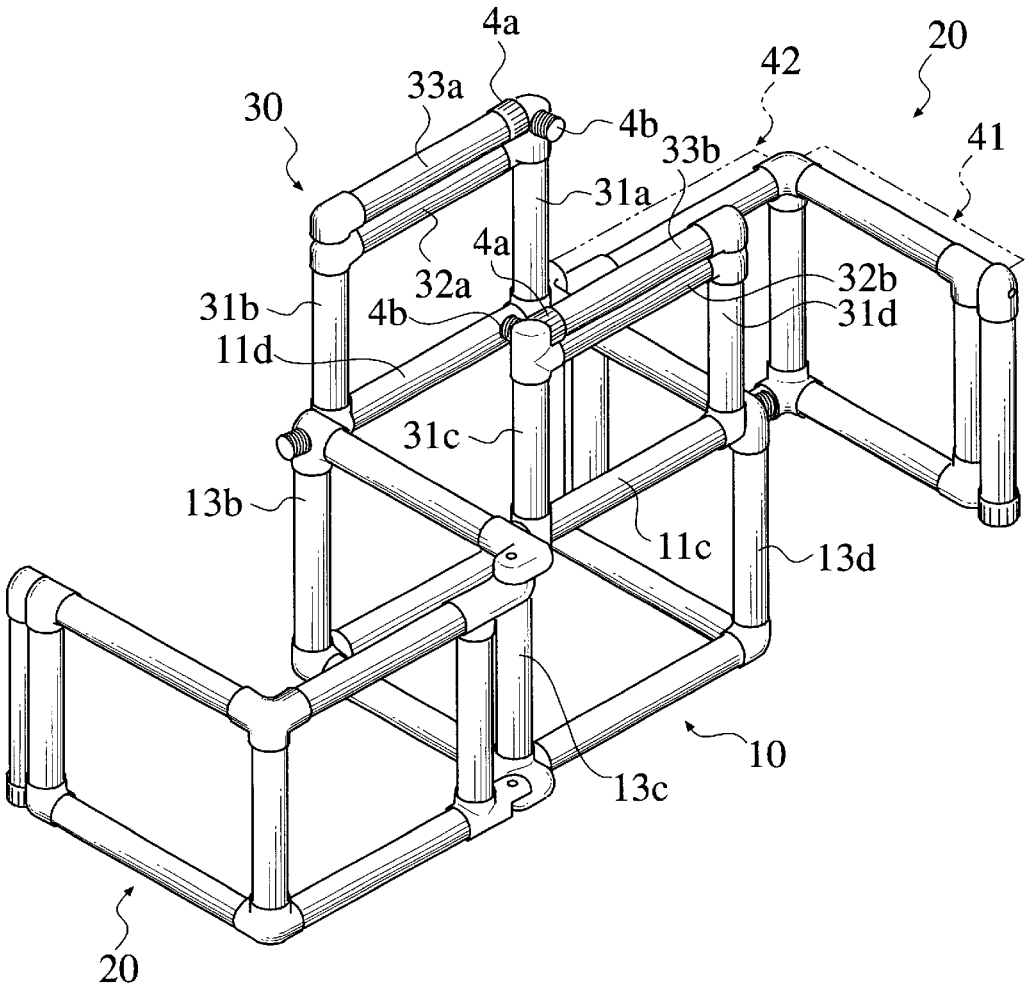
FIG. 9 is a perspective view showing an example of an assembling process for the jungle gym according to the embodiment of the present invention.

FIG. 6A is a perspective view of a jungle gym according to the present invention, showing that the jungle gym is unfolded. FIG. 7 is a perspective view showing that the jungle gym of FIG. 6A is folded. FIG. 8 and FIG. 9 are perspective views showing examples of assembling processes for the jungle gym shown in FIG. 7.

This jungle gym has a main frame body 10, sub-frame bodies 20, an upper frame body 30, and a slide 40. The sub-frame bodies 20 are successively connected to the main frame body 10 in a horizontal direction (the X direction, as shown in FIG. 6A) of the main frame body 10. The upper frame body 30 is successively connected to the main frame body 10 in an upward direction (the Z direction, as shown in FIG. 6A) of the main frame body 10. The slide 40 engages with one sub-frame body 20.

The main frame body 10 has four connecting bars 11*a*, 11*b*, 11*c*, and 11*d* arranged in the X direction, four connecting bars 12*a*, 12*b*, 12*c*, and 12*d* arranged in the Y direction, and four connecting bars 13*a*, 13*b*, 13*c*, and 13*d* arranged in the Z direction. Each edge of the connecting bars is connected mutually, so that the main frame body 10 has a shape of an approximate cube.

The sub-frame bodies 20 are connected to the edges of the connecting bars 13*a* and 13*c* of the main frame body 10 respectively, so that the sub-frame bodies 20 will turn freely around the connecting bars 13*a* and 13*c*. Two connecting bars 21*a* and 21*b* of the sub-frame bodies 20 extend from the edges of respective connecting bars 13*a* and 13*c* in the X direction and are connected to the edges of respective connecting bars 13*a* and 13*c* through hinges 1 (refer to enlarged view, as shown in FIG. 6B). A connecting bar 22*a* in the Z direction connects free edges of the connecting bars 21*a* and 21*b* mutually. Two connecting bars 23*a* and 23*b* extend from both edges of the connecting bar 22*a* in the Y direction and are combined with the both edges of the connecting bar 22*a*. A connecting bar 22*b* in the Z direction connects free edges of the connecting bars 23*a* and 23*b* mutually. Thus, by these connecting bars 21*a*, 21*b*, 22*a*, 23*a*, 23*b* and 22*b*, the sub-frame body 20 has a shape of an L when seeing from above.

In addition, in this jungle gym, a connecting bar 22*c* in the Z direction, which connects mutually the edges of the connecting bars 21*a* and 21*b*, intervenes therebetween. This connecting bar 22*c* is for reinforcement.

Figure 6D:
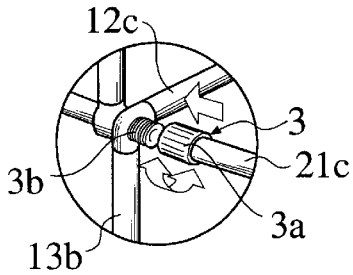
FIG. 6D is an enlarged view of a joint of the jungle gym of FIG. 6A.
Figure 6C:
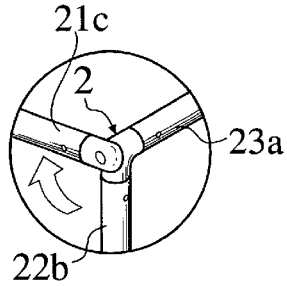
FIG. 6C is an enlarged view of a hinge of the jungle gym of FIG. 6A.

With this sub-frame body 20, an upper edge of connecting bar (a connecting turn bar or a movable connecting bar) 21*c*, which pivots freely on the connecting bar 23*a*, is attached to a free edge of the connecting bar 23*a* through a hinge 2 (refer to an enlarged view, as shown in FIG. 6C). One part 3*a* of a joint 3 is disposed at the nose of the connecting bar 21*c*, while the other part 3*b* of the joint 3 is disposed at the upper edge of the connecting bar 13*b* of the main frame body 10 in the Z direction, the connecting bar 13*b* facing to the connecting bar 21*c* (refer to an enlarged view, as shown in FIG. 6D). The one part 3*a* of the joint 3 has a loop that is revolved freely and fitted loosely around the connecting bar 21*c* and that slides freely in the direction of an axis of the connecting bar 21*c*. A female screw is formed in an inner surface of the loop. The other part 3*b* of the joint 3 has a projection, and a male screw is formed in an outer surface of this projection.

The connecting bar 21*c* is connected with the main frame body 10 by screwing the loop 3*a* of the joint 3 into the projection 3*b* of the joint 3. On the other hand, when the jungle gym is folded or collapsed, the one part 3*a* of the joint 3 is released from the other part 3*b* of the joint 3 in the main frame body 10, then the connecting bar 21*c* is turned downward to fold so as to overlap with the connecting bar 22*b*. Thus, the connecting bars 21*c* and 22*b* are disposed side by side.

The upper frame body 30 includes turn frames 30*a* and 30*a*. The upper frame body 30 comprises two couples of connecting bars 31*a* and 31*b*, and 31*c* and 31*d* attached to each edge of the two connecting bars 11*d* and 11*c* of the main frame body 10, while the connecting bars 31*a* and 31*b*, and 31*c* and 31*d* are capable of turning freely around the connecting bars lid and 11*c*, respectively. The upper frame body 30 also comprises connecting bars 32*a* and 32*b* in the X direction, connecting free edges of the two couples of connecting bars 31*a* and 31*b*, and 31*c* and 31*d* mutually. The upper frame body 30 also comprises connecting bars (connecting turn bars or movable connecting bars) 33*a* and 33*b*, each one edge of which is attached to each free edge of the connecting bars 31*b* and 31*d*, which are one of each couple of connecting bars 31*a* and 31*b*, and 31*c* and 31*d*. The connecting bars 33*a* and 33*b* turn freely around the connecting bars 31*b* and 31*d*. At the other edge of the each connecting bar 33*a* and 33*b*, one part 4*a* of a joint 4 is disposed, while the other part 4*b* of the joint 4 is disposed at each free edge of the bars 31*a* and 31*c*. Each part 4*a* of the joint 4 has a loop that revolves freely and fits loosely around the connecting bar 33*a* or 33*b* and that slides freely in the direction of an axis of the connecting bar 33*a* or 33*b*. A female screw is formed in an inner surface of the loop (refer to an enlarged view, as shown in FIG. 6E). The other part 4*b* of the joint 4 has a projection, and a male screw is formed in an outer surface of this projection.

The connecting bars 33*a* and 33*b* are connected with the connecting bars 31*a* and 31*c* by screwing the loops 4*a* of the joints 4 into the projections 4*b* of the joints 4. On the other hand, when the loops 4*a* of the joints 4 on the connecting bars 33*a* and 33*b* are released from the projections 4*b* of the joints 4 in the connecting bars 31*a* and 31*c*, the connecting bars 33*a* and 33*b* are turned and folded to overlap with the connecting bars 32*a* and 32*b*, so that the connecting bars 33*a* and 33*b* and the connecting bars 32*a* and 32*b* will be disposed side by side. Furthermore, while the connecting bars 31*a* and 31*b* are turned below to be received in a space formed by the connecting bars 11*d*, 13*a*, 13*b* and 11*a* of the main frame body 10, the connecting bars 31*c* and 31*d* are turned below to be received in a space formed by the connecting bars 11*c*, 13*c*, 13*d* and 11*b* of the main frame body 10.

A slide 40 has a board portion 41 and a slide portion 42, and is installed in one sub-frame body 20.

One side of the board portion 41 is coupled with the connecting bar 23*a* of the sub-frame body 20, with the board portion 41 turnable, while other sides are disposed on the connecting bar 12*d* of the main frame body 10 and/or the connecting bars 21*a* and 21*c*. This board portion 41 is turned and received in an outer side of a space formed by the connecting bars 23*a*, 22*a*, 22*b* and 23*b*. The slide portion 42 has telescopic portions 42*a* and 42*b*, which are joined to each other. One edge of the one portion 42*a* is attached to the connecting bar 21*a* of the sub-frame body 20, with the portion 42*a* turnable around the connecting bar 21*a*. A folding leg 43, which can turn freely, is arranged in an undersurface of the other portion 42*b*.

The portion 42*b* is pushed into the portion 42*a*, and the folding leg 43 is folded. Then, when the slide portion 42 is turned, it is received in an outer side of a space formed by the connecting bars 21*a*, 22*a*, 22*c* and 21*b*.

The jungle gym is folded as shown in FIG. 7, when it is not used. The sub-frame bodies 20 are folded along the main frame body 10. For unfolding and assembling the jungle gym, at first, both sub-frame bodies 20 are turned around the connecting bars 13*a* and 13*c* of the main frame body 10 and expanded as shown in FIG. 8. Then, the connecting bar 21*c* is turned 90 degrees around the connecting bar 23*a*, so that the one part 3*a* of the joint 3 at the nose of the connecting bar 21*c* is screwed into the other part 3*b* of the joint 3, which is formed in the main frame body 10 (see FIG. 6D).

Figure 1A:
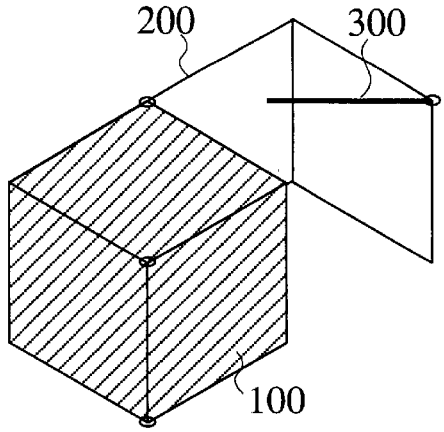
FIG. 1A is a conceptual perspective view of a jungle gym according to an example of the present invention.
Figure 1B:
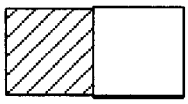
FIG. 1B is a front view of the jungle gym of FIG. 1A.
Figure 1C:
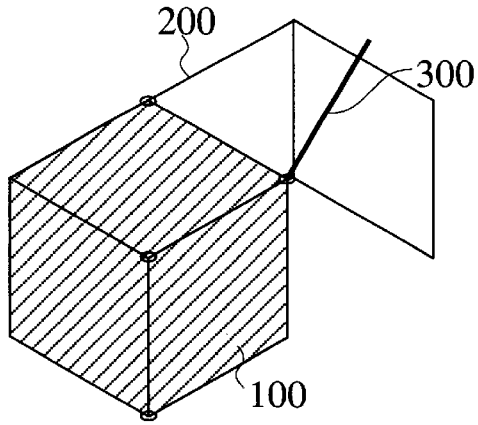
FIG. 1C is a conceptual perspective view of a jungle gym according to an example of the present invention.
Figure 1D:
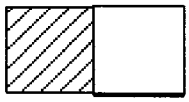
FIG. 1D is a front view of the jungle gym of FIG. 1C.
Figure 1E:
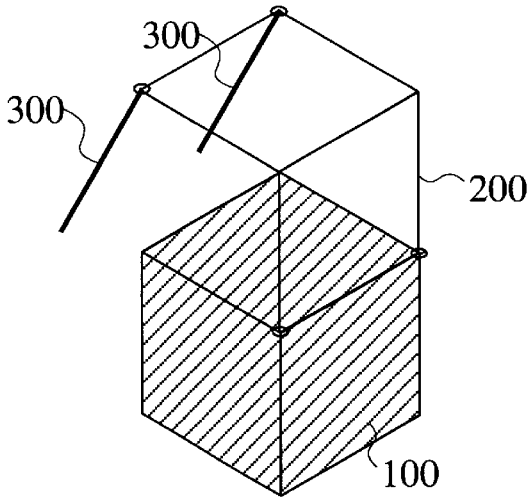
FIG. 1E is a conceptual perspective view of a jungle gym according to an example of the present invention.
Figure 1F:
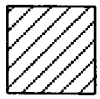
FIG. 1F is a bottom view of the jungle gym of FIG. 1E.
Figure 2A:
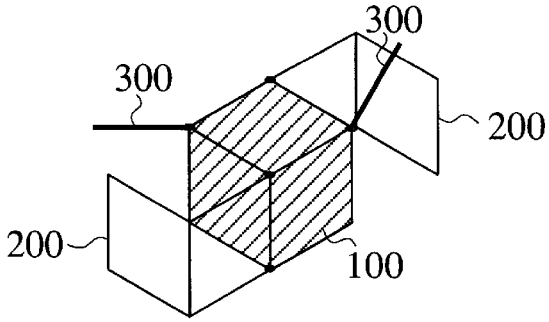
FIG. 2A is a conceptual perspective view of a jungle gym according to an example of the present invention.
Figure 2B:
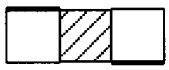
FIG. 2B is a front view of the jungle gym of FIG. 2A.
Figure 2C:
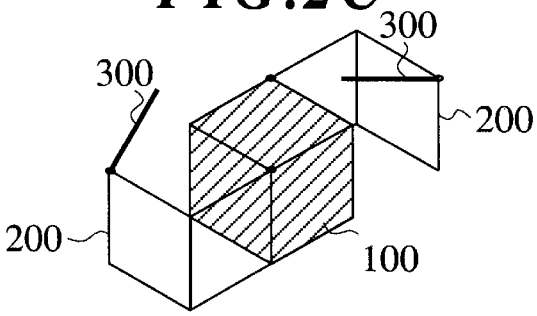
FIG. 2C is a conceptual perspective view of a jungle gym according to an example of the present invention.
Figure 2D:
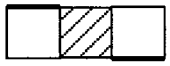
FIG. 2D is a front view of the jungle gym of FIG. 2C.
Figure 2E:
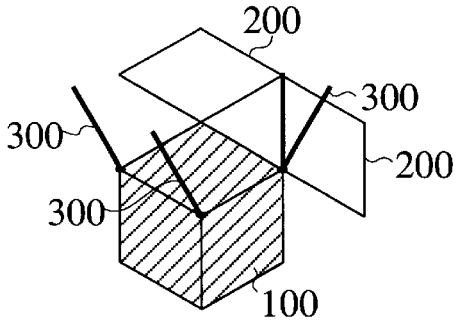
FIG. 2E is a conceptual perspective view of a jungle gym according to an example of the present invention.
Figure 2F:
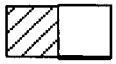
FIG. 2F is a bottom view of the jungle gym of FIG. 2E.
Figure 2G:
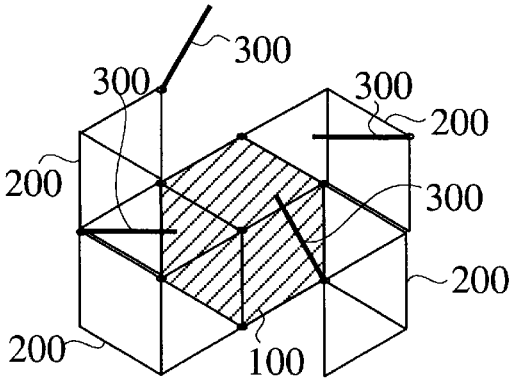
FIG. 2G is a conceptual perspective view of a jungle gym according to an example of the present invention.
Figure 2H:
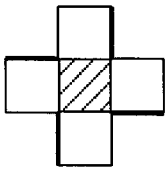
FIG. 2H is a front view of the jungle gym of FIG. 2G.
Figure 3A:
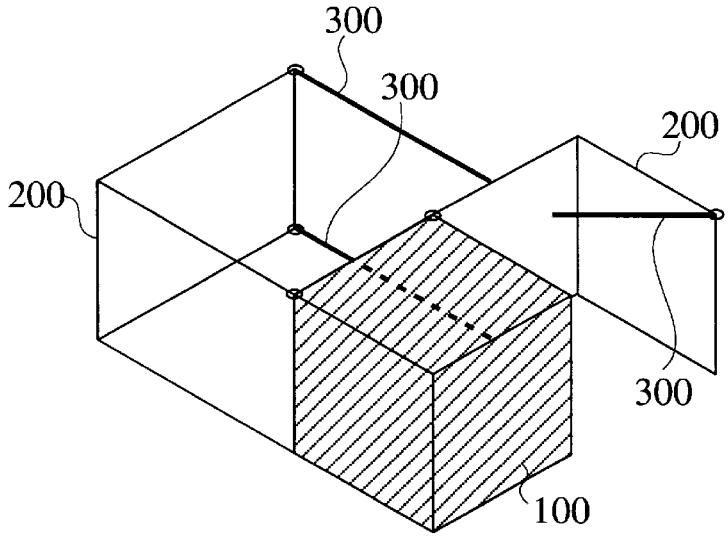
FIG. 3A is a conceptual perspective view of a jungle gym according to an example of the present invention.
Figure 3B:
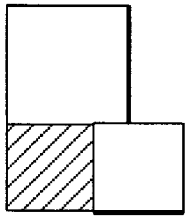
FIG. 3B is a front view of the jungle gym of FIG. 3A.
Figure 4A:
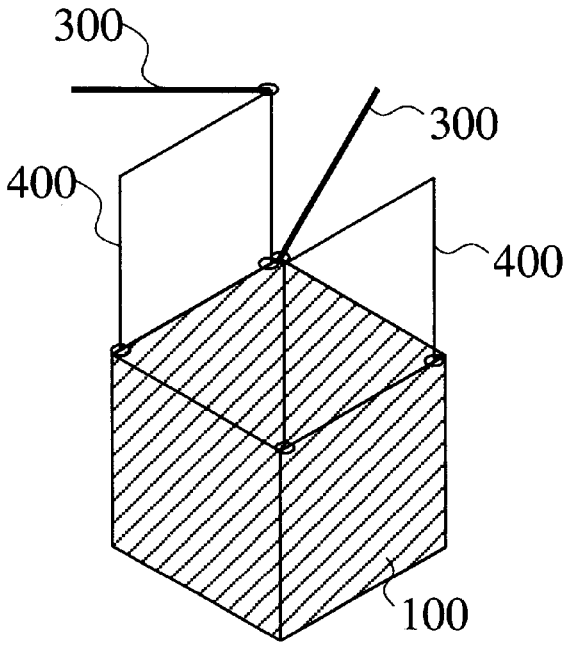
FIG. 4A is a conceptual perspective view of a jungle gym according to an example of the present invention.
Figure 4B:
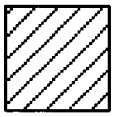
FIG. 4B is a bottom view of the jungle gym of FIG. 4A.
Figure 5A:
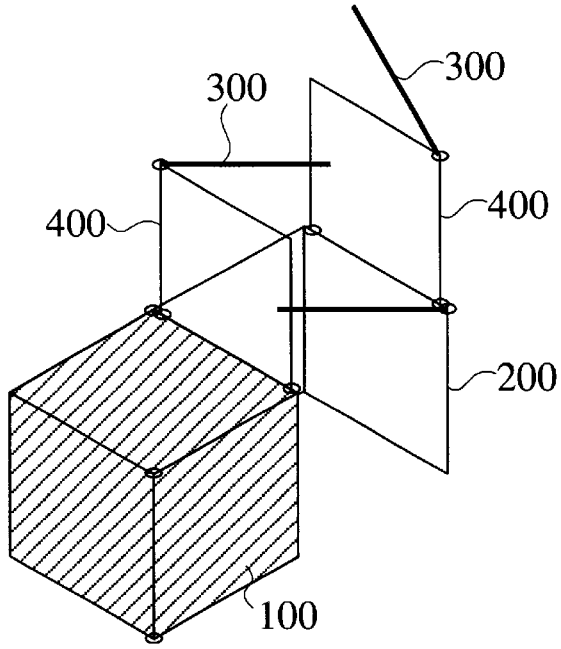
FIG. 5A is a conceptual perspective view of a jungle gym according to an example of the present invention.
Figure 5B:
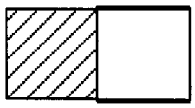
FIG. 5B is a front view of the jungle gym of FIG. 5A.

Next, the connecting bars 31*a*, 31*b*, 31*c* and 31*d* of the upper frame body 30 are turned upward, as shown in FIG. 4, around the connecting bars 11*d* and 11*c* of the main frame body 10. Then, the connecting bars 33*a* and 33*b* are turned, and respective one parts 4*a* of the joints 4 at the nose of the connecting bars 33*a* and 33*b* are screwed into respective the other parts 4*b* of the joints 4, which are formed in the connecting bars 31*a* and 31*c* (see FIG. 6E). Thereafter, the board portion 41 of the slide 40 is turned 270 degrees around the connecting bar 23*a* and disposed on the connecting bars 21*a* and 21*c* or the connecting bar 12*d* of the main frame body 10. Then, the slide portion 42 of the slide 40 is turned about 60 degrees around the connecting bar 21*a* of the sub-frame body 20. Further, the portion 42*b* is drawn out of the portion 42*a*, and the folding leg 43 is turned to project downward (see FIG. 6A).

In order to fold or collapse the jungle gym assembled as described above, only adverse operations of the above-mentioned operations may be required.

In the above-described embodiment, the board portion 41 and the slide portion 42 of the slide 40 are coupled with the connecting bars 21*a* and 23*a* of the sub-frame body 20, respectively, with the board portion 41 and the slide portion 42 turnable freely, and they are turned and received. However, the board portion 41 and the slide portion 42 of the slide 40 may be separated from the sub-frame body 20. After assembling the sub-frame body 20, the board portion 41 may be disposed on and attached to the sub-frame body 20, or the upper edge of the slide portion 42 may be attached to the connecting bar 21*a*.

Moreover, with the above-described embodiment, although the slide 40 includes the board portion 41 and the slide portion 42, either the board portion 41 or the slide portion 42 can be used alone.

According to the jungle gym of the embodiment, since it can be usable when the sub-frame body is unfolded, assembly is easy. Moreover, since it will be in a storage or receipt state when it is folded, storage or receipt is also easy. Furthermore, when it is folded, it will be miniaturized.

The entire disclosure of Japanese Patent Application (Tokugan) No. 2000-167753 filed on Jun. 5, 2000 including specification, claims, drawings and summary are incorporated herein by reference in its entirety.

What is claimed is:

1. A jungle gym, comprising:

a main frame body comprising connecting bars extending vertically or horizontally, the main frame body having a shape of at least one of an approximate cube and an approximate rectangular parallelepiped as a whole by connecting the connecting bars;

a sub-frame body being attached to the main frame body and turnable around one of the connecting bars of the main frame body or around an axis being parallel to the one of a the connecting bars, and the sub-frame body being capable of folding along the main frame body by turning the sub-frame body around the one of the connecting bars of the main frame body or around the axis being parallel to the one of the connecting bars in a state that the sub-frame body is connected to the main frame body; and a connecting turn bar, wherein one end of the connecting turn bar is attached to at least one of the main frame body and the sub-frame body, and the connecting turn bar is capable of turning along a vertical plane or a horizontal plane by using one end thereof as a fulcrum and is capable of folding to overlap with an adjacent connecting bar by turning the connecting turn bar, such that the connecting turn bar bridges between the main frame body and the sub-frame body, and the other end of the connecting bar is connected detachably to a rest of the main frame body and the sub-frame body by a joint.

2. The jungle gym as claimed in claim 1, wherein the jungle gym comprises two or more sub-frame bodies.

3. The jungle gym as claimed in claim 1, further comprising:

two turn frames, each being independently attached to two parallel connecting bars among the connecting bars of the main frame body, and being capable of turning along a plane, which is perpendicular to the two connecting bars, and of moving into a storage position in the main frame body; and a second connecting turn bar being attached to at least one turn frame, being capable of folding to overlap with an adjacent connecting bar, the second connecting turn bar being bridged between the two turn frames when the second connecting turn bar is unfolded, and the second connecting turn bar being detachably connected to the other turn frame by a joint.

4. A jungle gym comprising:

a main frame body comprising connecting bars extending vertically or horizontally, the main frame body having a shape of at least one of an approximate cube and an approximate rectangular parallelepiped as a whole by connecting the connecting bars;

a plurality of sub frame bodies being attached to the main frame body and capable of turning along a vertical plane or a horizontal plane, and the sub frame bodies being capable of folding along the main frame body by turning each of the sub frame bodies around one of the connecting bars of the main frame body or around an axis being parallel to the one of the connecting bars in a state that the sub frame bodies are connected to the main frame body;

a first connecting turn bar being attached to at least one of the main frame body and the sub-frame body, being capable of turning along a vertical plane or a horizontal plane and of folding to overlap with an adjacent connecting bar, the first connecting turn bar being bridged at least one of between the main frame body and the sub-frame body and between the sub frame bodies, and the first connecting turn bar being connected detachably thereto by a joint;

two turn frames, each being attached independently to two parallel connecting bars among the connecting bars of the main frame body, and being capable of turning along a plane, which is perpendicular to the two connecting bars, and of moving into a storage position in the main frame body; and a second connecting turn bar being attached to at least one turn frame, being capable of folding to overlap with an adjacent connecting bar, the second connecting turn bar being bridged between the two turn frames when the second connecting turn bar is unfolded, and the second connecting turn bar being detachably connected to the other turn frame by a joint.

5. The jungle gym as claimed in claim 1, further comprising:

two turn frames, each being attached independently to two parallel connecting bars among the connecting bars of the main frame body and the sub-frame body, and being capable of turning along a plane, which is perpendicular to the two connecting bars, and of moving into a storage position in a frame body including the connecting bars; and a second connecting turn bar being attached to at least one turn frame, being capable of folding to overlap with an adjacent connecting bar, the second connecting turn bar being bridged between the two turn frames when the second connecting turn bar is unfolded, and the second connecting turn bar being detachably connected to the other turn frame by a joint.

6. A jungle gym comprising:

a main frame body comprising connecting bars extending vertically or horizontally, the main frame body having a shape of at least one of an approximate cube and an approximate rectangular parallelepiped as a whole by connecting the connecting bars;

a plurality of sub frame bodies being attached to the main frame body and capable of turning along a vertical plane or a horizontal plane, and the sub frame bodies being capable of folding along the main frame body by turning each of the sub frame bodies around one of the connecting bars of the main frame body or around an axis being parallel to the one of the connecting bars in a state that the sub frame bodies are connected to the main frame body;

a first connecting turn bar being attached to at least one of the main frame body and the sub-frame body, being capable of turning along a vertical plane or a horizontal plane and of folding to overlap with an adjacent connecting bar, the first connecting turn bar being bridged at least one of between the main frame body and the sub-frame body and between the sub-frame bodies, and the first connecting turn bar being connected detachably thereto by a joint;

two turn frames, each being attached independently to two parallel connecting bars among the connecting bars of the main frame body and the sub-frame body, and being capable of turning along a plane, which is perpendicular to the two connecting bars, and of moving into a storage position in a frame body including the connecting bars; and a second connecting turn bar being attached to at least one turn frame, being capable of folding to overlap with an adjacent connecting bar, the second connecting turn bar being bridged between the two turn frames when the second connecting turn bar is unfolded, and the second connecting turn bar being detachably connected to the other turn frame by a joint.

7. The jungle gym as claimed in claim 1, wherein the sub-frame body is capable of being unfolded beside the main frame body, the jungle gym further comprises a board being attached to an upper connecting bar of the sub-frame body and turnable along a vertical plane, and the board is capable of folding to overlap with the sub-frame body and of being held horizontally by support of another connecting bar.

8. A jungle gym, comprising:

a main frame body comprising connecting bars extending vertically or horizontally, the main frame body having a shape of at least one of an approximate cube and an approximate rectangular parallelepiped as a whole by connecting the connecting bars;

a plurality of sub frame bodies being attached to the main frame body and capable of turning along a vertical plane or a horizontal plane, and the sub frame bodies being capable of folding along the main frame body by turning each of the sub frame bodies around one of the connecting bars of the main frame body or around an axis being parallel to the one of the connecting bars in a state that the sub frame bodies are connected to the main frame body; and a first connecting turn bar being attached to at least one of the main frame body and the sub-frame body, being capable of turning along a vertical plane or a horizontal plane and of folding to overlap with an adjacent connecting bar, the first connecting turn bar being bridged at least one of between the main frame body and the sub-frame body and between the sub frame bodies, and the first connecting turn bar being connected detachably thereto by a joint;

wherein the sub-frame body is capable of being unfolded beside the main frame body, the jungle gym further comprises a board being attached to an upper connecting bar of the sub-frame body and turnable along a vertical plane, and the board is capable of folding to overlap with the sub-frame body and of being held horizontally by support of another connecting bar.

9. The jungle gym as claimed in claim 7, further comprising a slide being attached to an upper connecting bar of the sub-frame body and turnable along a vertical plane, the slide being capable of folding along the sub-frame body and telescopic, and a folding leg is provided to a back side of the slide.

10. The jungle gym as claimed in claim 8, further comprising a slide being attached to an upper connecting bar of the sub-frame body and turnable along a vertical plane, the slide being capable of folding along the sub-frame body and telescopic, and a folding leg is provided to a back side of the slide.

11. The jungle gym as claimed in claim 1, wherein the sub-frame body has at least two squares, which are formed from the connecting bars and share with one connecting bar to form an L-like shape.

12. The jungle gym as claimed in claim 11, wherein the sub-frame body overlaps with two sides of the main frame body when the sub-frame body is folded.

13. The jungle gym as claimed in claim 9, wherein the main frame body and the sub-frame body have a plurality of squares formed from the connecting bars, and when the jungle gym is folded, the jungle gym has a similar shape as the shape of the main frame body.

14. The jungle gym as claimed in claim 1, wherein the connecting turn bar is attached to a corner of the main frame body or the sub-frame body.

15. A jungle gym, comprising:

a main frame body comprising connecting bars extending vertically or horizontally, the main frame body having a shape of at least one of an approximate cube and an approximate rectangular parallelepiped as a whole by connecting the connecting bars;

two turn frames, each being independently attached to two parallel connecting bars among the connecting bars of the main frame body, and being capable of turning along a plane, which is perpendicular to the two connecting bars, and of moving into a storage position in the main frame body in a state that the two turn frames are connected to the two connecting bars; and a connecting turn bar being attached to at least one turn frame, being capable of folding, the connecting turn bar being bridged between the two turn frames when the connecting turn bar is unfolded, and the connecting turn bar being detachably connected to the other turn frame by a joint.

* * * * *